US006201940B1

(12) United States Patent
Lee

(10) Patent No.: US 6,201,940 B1
(45) Date of Patent: Mar. 13, 2001

(54) TRANSFER ROLLER CLEANING APPARATUS OF LIQUID ELECTROPHOTOGRAPHIC PRINTER

(75) Inventor: Chang-soo Lee, Suwon (KR)

(73) Assignee: Samsung Electronics Co., Ltd., Kyungki-do (KR)

( * ) Notice: Subject to any disclaimer, the term of this patent is extended or adjusted under 35 U.S.C. 154(b) by 0 days.

(21) Appl. No.: 09/248,123

(22) Filed: Feb. 11, 1999

(30) Foreign Application Priority Data

Feb. 11, 1998 (KR) ..... 98-4004

(51) Int. Cl.[7] ..... G03G 21/00

(52) U.S. Cl. ..... 399/101; 15/256.52; 399/99; 399/123

(58) Field of Search ..... 399/99–101, 123, 399/249, 313, 307, 237, 250, 251, 345, 348, 357, 326, 327; 15/256.51, 256.52

(56) References Cited

U.S. PATENT DOCUMENTS 4,018,555 * 4/1977 Thettu ..... 219/216
4,183,655 * 1/1980 Umahashi et al. ..... 399/101
4,705,388 * 11/1987 Huntjens et al. ..... 399/327
4,910,558 * 3/1990 Giezeman et al. ..... 399/308
4,949,130 * 8/1990 Torino ..... 399/328
5,678,134 * 10/1997 Miki et al. ..... 15/1.51
5,678,153 * 10/1997 Okamoto et al. ..... 399/327
5,729,788 * 3/1998 Hirohashi et al. ..... 399/101 X
5,768,672 * 6/1998 Van Herpen et al. ..... 399/101 X
5,870,650 * 2/1999 Takahashi et al. ..... 399/101 X

FOREIGN PATENT DOCUMENTS 6-27833 * 2/1994 (JP) .
8-286530 11/1996 (JP) ..... G03G/15/16
9-258631 10/1997 (JP) ..... G03G/21/10
11-272096 * 10/1999 (JP) .

* cited by examiner

*Primary Examiner*—Quana M. Grainger
(74) *Attorney, Agent, or Firm*—Sughrue, Mion, Zinn, Macpeak & Seas, PLLC

(57) ABSTRACT

A transfer roller cleaning apparatus of a liquid electrophotographic printer for removing toner particles and foreign matter remaining on a transfer roller for transferring a toner image formed on a photoreceptor belt. The transfer roller includes a cleaning roller for cleaning the surface of the transfer roller while rotating in contact with a transfer surface of the transfer roller.

2 Claims, 3 Drawing Sheets

TRANSFER ROLLER CLEANING APPARATUS OF LIQUID ELECTROPHOTOGRAPHIC PRINTER

BACKGROUND OF THE INVENTION

1. Field of the Invention

The present invention relates to a liquid electrophotographic printer, and more particularly, to a transfer roller cleaning apparatus for cleaning the surface of a transfer roller which transfers a developed image formed on a photoreceptor medium to a printing sheet of paper.

2. Description of the Related Art

In an electrophotographic printer, a latent electrostatic image formed on a photoreceptor medium such as a photoreceptor drum or a photoreceptor belt is developed by using a developing solution having a toner mixed with a volatile liquid carrier, and the developed image is transferred onto a printing sheet of paper, thereby printing a desired image.

Referring to FIG. 1 schematically showing a conventional liquid electrophotographic color printer, a photoreceptor belt 110 is supported by a plurality of rollers 121, 122 and 123 and circulates along an endless track. The surface of the photoreceptor belt 110 is charged by a charging station 150 to a constant electric potential. Then, a latent electrostatic image is formed on the photoreceptor belt 110 by a laser scanning unit 130 for emitting laser beams according to image signals. The formed latent electrostatic image is developed by a development station 140 for supplying a developing solution. As shown in FIG. 1, in the case of a color printer, a plurality of laser scanning units 130 and development stations 140 corresponding to various colors are provided.

The liquid carrier contained in the developing solution sticking to the latent electrostatic image of the photoreceptor belt 110 is evaporated while passing an image drying station 160 and then only the dried toner remains.

Subsequently, while the photoreceptor belt 110 passes through between the roller 121 and a transfer roller 124, an image formed by the toner sticking to the photoreceptor belt 110 is transferred to a sheet 126 fed between the transfer roller 124 and a fixing roller 125 via the transfer roller 124, to then be printed. Thereafter, an electrostatic charge remaining in the photoreceptor belt 110 is removed by an erasure station 170.

Here, the toner image sticking to the transfer roller 124 is not completely transferred to the sheet 126 during the transfer procedure, and some toner sludge may remain in the transfer roller 124. The residual toner sludge or foreign matter sticking to the transfer roller 124 may contaminate the surface of the transfer roller 124 in repetitive printing procedures, thereby adversely affecting the printing quality of an image.

SUMMARY OF THE INVENTION

To solve the above problem, it is an objective of the present invention to provide a transfer roller cleaning apparatus of an electrophotographic printer, for removing toner sludge or foreign matter sticking to the surface of a transfer roller.

Accordingly, to achieve the above objective, there is provided a transfer roller cleaning apparatus of a liquid electrophotographic printer including a photoreceptor belt supported by a plurality of rotation rollers rotatably installed in a printer body and circulating on an endless track, a transfer roller for transferring a developed image formed on a photosensitive surface of the photoreceptor belt to a printing sheet, and a cleaning roller for cleaning the surface of the transfer roller while circulating in contact with a transfer surface of the transfer roller.

According to the transfer roller cleaning apparatus of the present invention, the cleaning roller has a heat source provided around its rotation shaft so that a heat generated from the heat source is conducted to the outer circumferential surface of the cleaning roller. The circumferential surface of the cleaning roller preferably has a larger surface energy than that of the transfer roller. To this end, a coating film made of metal or synthetic resin may be formed on the outer circumferential surface of the cleaning roller.

According to another aspect of the present invention, the cleaning roller is detachably installed with respect to the transfer roller.

Alternatively, there is provided a transfer roller cleaning apparatus of a liquid electrophotographic printer including a photoreceptor belt supported by a plurality of rotation rollers rotatably installed in a printer body and circulating on an endless track, a transfer roller for transferring a developed image formed on a photosensitive surface of the photoreceptor belt to a printing sheet, a driving roller and a driven roller installed in parallel at one side of the transfer roller, and a cleaning belt supported by the driving roller and the driven roller, for cleaning the surface of the transfer roller while circulating on an endless track in contact with a transfer surface of the transfer roller.

A coating film made of a metal such as aluminum oxide ($Al_2O_3$) or a synthetic resin can be formed on the outer circumferential surface of the cleaning roller so that the circumferential surface of the cleaning belt has a larger surface energy than that of the transfer roller. Also, the cleaning roller may be detachably installed with respect to the transfer roller.

BRIEF DESCRIPTION OF THE DRAWINGS

The above objective and advantages of the present invention will become more apparent by describing in detail a preferred embodiment thereof with reference to the attached drawings in which.

DESCRIPTION OF THE PREFERRED EMBODIMENTS

Figure 1:
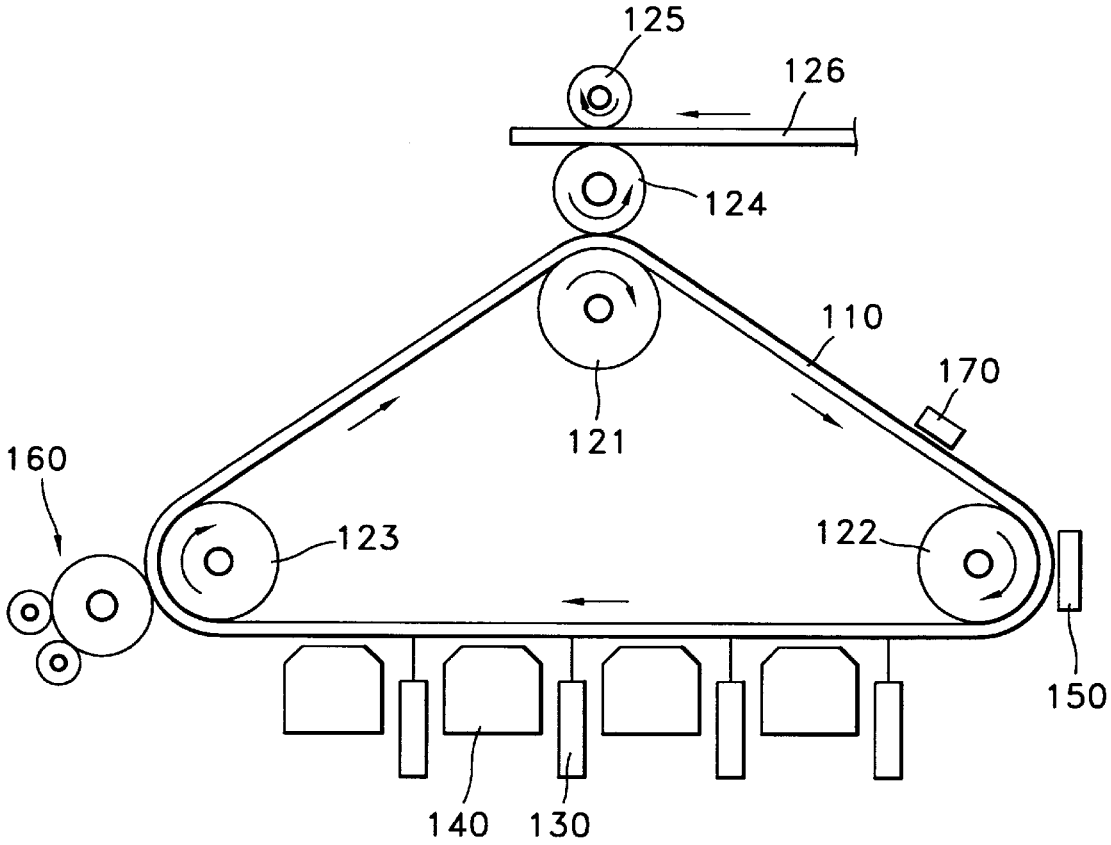
FIG. 1 (PRIOR ART)
FIG. 1 is a schematic diagram of a conventional liquid electrophotographic printer.
Figure 2:
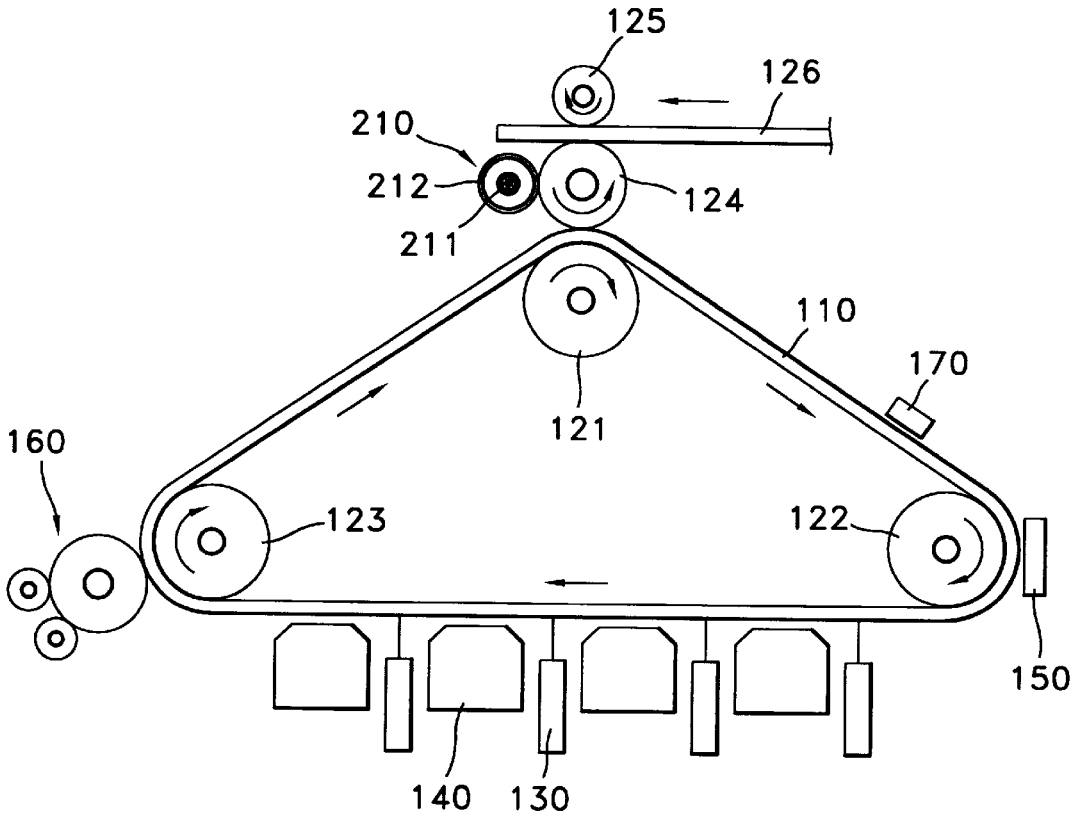
FIG. 2 is a schematic diagram of a liquid electrophotographic printer having a transfer roller cleaning apparatus according to an embodiment of the present invention.
Figure 3:
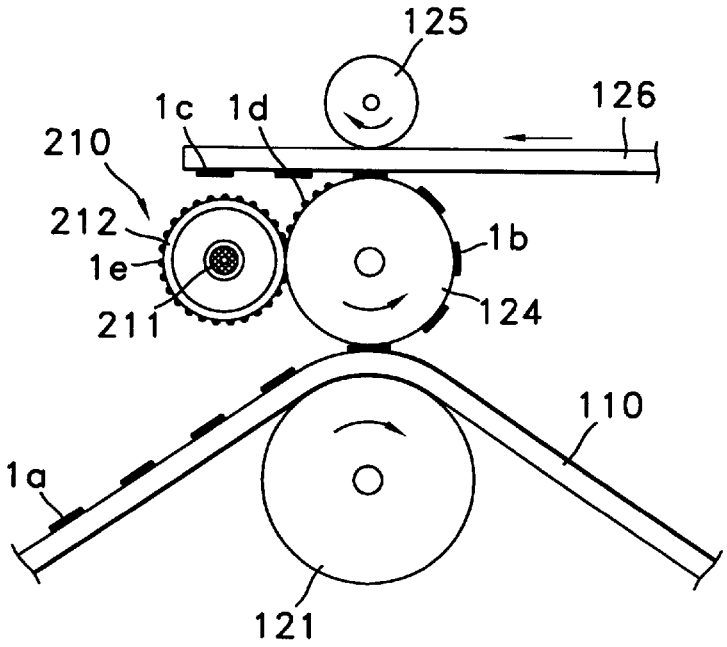
FIG. 3 is a partly extracted diagram illustrating essential parts of the transfer roller cleaning apparatus shown in FIG. 2, for explaining the operation of the same.

Referring to FIGS. 2 and 3, a transfer roller cleaning apparatus of a liquid electrophotographic apparatus according to an embodiment of the present invention will be described in detail. Here, the same reference numerals as those shown above represent the same elements.

The transfer roller cleaning apparatus according to this embodiment, as shown in the drawings, includes a cleaning roller 210 rotating in contact with the outer circumferential surface of the transfer roller 124.

As shown in FIG. 3, the cleaning roller 210 performs a cleaning operation such that a toner image 1*a* formed on the photoreceptor belt 110 as a latent electrostatic image is transferred to the transfer roller 124 as a transferred image 1*b* while the cleaning roller 210 rotates in close contact with the outer circumferential surface of the transfer roller 124, to then be printed on the printing sheet 126 as an image 1*c* when the transfer roller 124 rotates about a half cycle, and then a toner sludge 1*d* remaining after the printing operation is cleaned off the transfer roller 124. Here, the toner sludge 1*d* remaining on the transfer roller 124 sticks to the outer circumferential surface of the cleaning roller 210 due to a difference between surface energies of the transfer roller 124 and the cleaning roller 210.

According to the present invention, the cleaning roller 210 is preferably formed of a metal having an excellent thermal conductivity. Also, the cleaning roller 210 includes a heat source 211, such as a heater lamp installed around its rotation shaft, so that a heat generated from the heat source 211 can be conducted to the outer circumferential surface of the cleaning roller 210.

The outer circumferential surface of the cleaning roller 210 has a coating film 212 such as an aluminum oxide ($Al_2O_3$) film so as to have a larger surface energy than that of the transfer roller 124. The coating film 212 is not restricted to a metal film but any material, e.g., synthetic resin or rubber, can be employed if only the requirement in which the outer circumferential surface of the cleaning roller 210 has a larger surface energy than that of the transfer roller 124 is satisfied.

In the transfer roller cleaning apparatus of a liquid electrophotographic printer having the aforementioned configuration, according to the present invention, the toner image 1*b* transferred from the photoreceptor belt 110 to the transfer roller 124 is transferred to the printing sheet 126 when the transfer roller 124 rotates about a half cycle, to then be printed as a desired image (1*c* of FIG. 3). Here, the toner image l*b* transferred to the transfer roller 124 is not completely transferred to the printing sheet 126 and a trivial amount of the toner sludge 1*d* remains on the surface of the transfer roller 124. At a contact portion of the transfer roller 124 and the cleaning roller 210, the residual toner sludge 1*d* is transferred to the surface of the cleaning roller 210 having a larger surface energy than that of the transfer roller 124, and is thus removed from the transfer roller 124. Here, foreign matter such as fine powder or dust separated from the printing sheet 126 while the printing sheet is being transferred is also transferred to the surface of the cleaning roller 210, as defined by reference numeral 1*e* in FIG. 3, thereby achieving the transfer roller cleaning operation. In this manner, even though the transfer roller 124 keeps rotating, the residual toner and foreign matter 1*e* do not stick to the transfer roller 124 again due to a difference between surface energies.

The residual toner which is not transferred from the transfer roller 124 to the printing sheet 126 and the foreign matter such as fine powder or dust separated from the printing sheet 126 are accumulated on the cleaning roller 210 while the printing operations are repeated, thereby forming a layer of toner particles 1*e*. If the toner particles 1*e*, including the restored toner and foreign matter, completely cover the surface of the cleaning roller 210, the toner and foreign matter remaining on the transfer roller 124 continue to be drawn to the cleaning roller 210 by the layer of the restored toner particles 1*e* on the cleaning roller 210 to then be accumulated thereon. That is to say, since the surface energy between toner particles is larger than that between the transfer roller 124 and the toner particle, the layer of the toner particles 1*e* sticking to the cleaning roller 210 draws the toner sludge 1*d* remaining on the transfer roller 124. The efficiency for recovering the residual toner due to a difference between surface energies can be enhanced by transmitting the heat generated from the heat source 211 provided around the rotation shaft of the cleaning roller 124 to the outer circumferential surface of the cleaning roller 210 to maintain an appropriate temperature.

According to another aspect of the present invention, the cleaning roller 210 may be detachably constructed with respect to the transfer roller 124, by movably installing its rotation shaft using an actuator. Thus, when the surface of the cleaning roller 210 is completely covered by the recovered toner particle layer so as to lower the residual toner recovery efficiency of the cleaning roller 210, the cleaning roller 210 can be easily replaced with new one.

Figure 4:
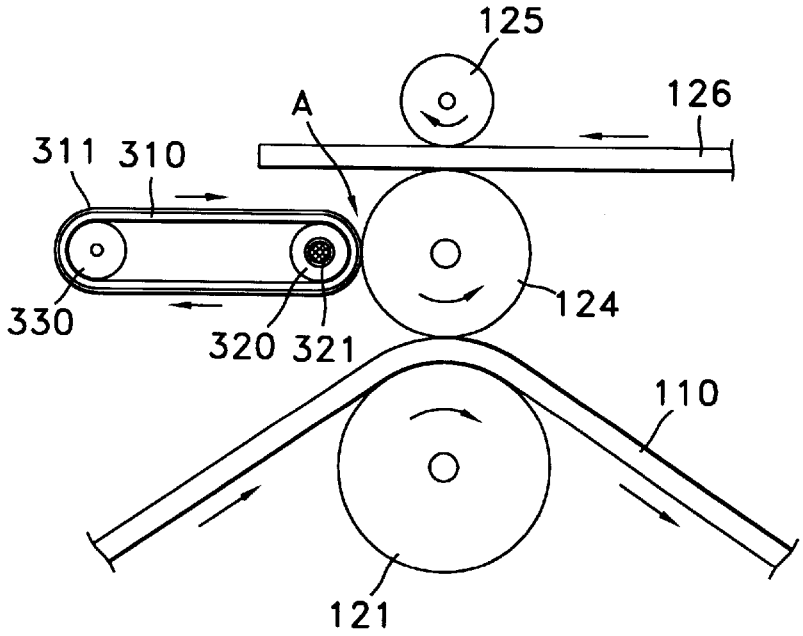
FIG. 4 is a view similar to FIG. 3 but illustrating a transfer roller cleaning apparatus according to another embodiment of the present invention.

FIG. 4 is a view illustrating a transfer roller cleaning apparatus according to another embodiment of the present invention. According to this embodiment, a cleaning belt 310 supported by a driving roller 320 and a driven roller 330 and traveling on an endless track is partially in close contact with the outer circumferential surface of the transfer roller 124 provided at one side of the transfer roller 124.

The cleaning belt 310 includes a coating film 311 made of metal such as aluminum oxide ($Al_2O_3$) or synthetic resin so that its outer circumferential surface may have a larger surface energy than the outer circumferential surface of the transfer roller 124.

In the transfer roller cleaning apparatus of a liquid electrophotographic printer according to the embodiment shown in FIG. 4, as in the embodiment shown in FIGS. 2 and 3, the toner particles and foreign matter remaining on the transfer roller 124 are transferred to the surface of the cleaning belt 310 at the contact portion "A" of the transfer roller 124 and the cleaning belt 310 due to a difference between surface energies of the transfer roller 124 and the cleaning belt 310, thereby achieving the cleaning operation of the transfer roller 124.

Also, according to this embodiment, a heat source 321 is installed around a rotation shaft of either the driving roller 320 or the driven roller 330 so that heat generated from the heat source 321 can be transmitted to the outer circumferential surface of the cleaning belt 310, thereby increasing the residual toner recovery efficiency due to a surface energy difference between the transfer roller 124 and the cleaning belt 310. Also, the cleaning belt 310 may be detachably constructed with respect to the transfer roller 124, by movably installing the driving roller 320 using an actuator. According to this configuration, when the surface of the cleaning belt 310 is completely covered by the recovered toner particle layer so as to lower the residual toner recovery efficiency, the cleaning belt 310 can be easily replaced with a new one.

As described above, in the transfer roller cleaning apparatus of a liquid electrophotographic printer according to the present invention, the toner particles and foreign matter remaining on a transfer roller are recovered by a cleaning roller rotating in close contact with the transfer roller, thereby improving printing quality of an image.

What is claimed is:

1. A transfer roller cleaning apparatus of a liquid electrophotographic printer, comprising:

a photoreceptor belt supported by a plurality of rotation rollers rotatably installed in a printer body and circulating on an endless track;

a transfer roller for transferring a developed image formed on a photosensitive surface of the photoreceptor belt to a printing sheet; and a cleaning roller for cleaning the surface of the transfer roller while rotating in contact with a transfer surface of the transfer roller, wherein a coating film made of one of a metal and a synthetic resin is formed on an outer circumferential surface of the cleaning roller; and wherein the coating film is made of aluminum oxide ($Al_2O_3$).

2. A transfer roller cleaning apparatus of a liquid electrophotographic printer, comprising:

a photoreceptor belt supported by a plurality of rotation rollers rotatably installed in a printer body and circulating on an endless track;

a transfer roller for transferring a developed image formed on a photosensitive surface of the photoreceptor belt to a printing sheet;

a driving roller and a driven roller installed in parallel at one side of the transfer roller; and a cleaning belt supported by the driving roller and the driven roller, for cleaning a transfer the surface of the transfer roller while circulating on an endless track in contact with the transfer surface of the transfer roller, wherein a coating film made of one of a metal and a synthetic resin is formed on an outer circumferential surface of the cleaning belt; and wherein the coating film is made of aluminum oxide ($Al_2O_3$).

* * * * *